United States Patent [19]

Player, Jr.

[11] Patent Number: 4,778,014

[45] Date of Patent: Oct. 18, 1988

[54] VENTILATING MEANS

[75] Inventor: Henry C. Player, Jr., Fayetteville, N.C.

[73] Assignee: Vent-A-Deck, Fayetteville, N.C.

[21] Appl. No.: 736,129

[22] Filed: May 20, 1985

[51] Int. Cl.[4] ..... B21J 5/00

[52] U.S. Cl. ..... 173/1; 173/18; 173/50; 173/52; 173/157

[58] Field of Search ..... 173/22, 51, 52, 171, 173/38, 39, 50, 19, 101, 102, 1, 141, 156, 157, 18; 52/749; 83/928; 72/325; 29/34 R, 6.2; 175/53, 96; 299/62; 408/10, 12, 14, 15

[56] References Cited

U.S. PATENT DOCUMENTS

| | | | |
|---|---|---|---|
| 2,562,899 | 8/1951 | Finn | 173/52 |
| 2,635,855 | 4/1953 | Gunning | 173/22 |
| 3,157,070 | 11/1964 | Heidrich | 173/157 |
| 3,163,064 | 12/1964 | Blackmon | 83/867 |
| 3,353,323 | 11/1967 | Livermore | 52/749 |
| 4,410,053 | 10/1983 | Masse | 175/53 |

*Primary Examiner*—Frank T. Yost
*Assistant Examiner*—James L. Wolfe
*Attorney, Agent, or Firm*—Mills & Coats

[57] ABSTRACT

This invention is a machine for ventilating roof decks which, without such ventilation, entraps moisture which leads to reduced insulating capacity, deterioration and the like. This ventilating device includes a mobile carriage, an extensible lift and an impact head along with associated operating mechanisms.

7 Claims, 4 Drawing Sheets

VENTILATING MEANS

FIELD OF INVENTION

This invention relates to equipment used in conjunction with static structures and more particularly to roof ventilating means.

BACKGROUND OF INVENTION

Since mankind first began to build free-standing structures to live and work in, there has been a problem in devising roof structures which are water tight and have acceptable insulating qualities. These problems are compounded even further by the need for making the roof structures reasonable in cost. This is particularly true for large area roof structures such as these commonly found on commercial buildings such as shopping centers, warehouses and the like.

To meet the increasing need for large area roof structures which are water tight and have acceptable insulating and fire resistant qualities, lightweight insulating concrete decks have been resorted to. Traditionally, support beams have been erected with structural concrete forming such as corrugated sheet metal laid thereover. The lightweight concrete is then pumped with a water mixture to the desired thickness and, after properly setting, a waterproof coat is added to the exterior surface. Literally thousands of buildings, shopping centers, gymnasiums, and the like have roofs of this type. After the waterproofing exterior top surface is applied, then the excess free pumping moisture must dry or vent as vapor downward over a period of months to achieve improved insulation qualities and prevent deterioration. Corrugated metal forms without vent or weep holes retain considerable moisture for years, even when roof top vents are used. In those structures where harmful moisture does eventually vent out, moisture from cracks or other openings in the exterior surface, from normal condensation between the corrugated and waterproofed layers, together with retained portions of initial placement water, or by other means accumulates in the roof, thus reducing its insulating capacity and eventually causing deterioration of the entire roof structure.

The above moisture has become such a widespread problem that in new construction weep holes are provided in the corrugated layer in an effort to allow initial placement water trapped moisture to escape. The holes must either be extremely small so that the lightweight concrete poured thereover will not run through the openings or the same must be covered with a liquid impervious material to prevent running.

As to pre-existing roof structures built prior to the availability of corrugations with weep holes, the only alternatives have been to either remove the waterproof exterior layer, allow the concrete surface to dry out, and reseal the same, or, in the alternative, replace the entire roof structure. Neither of these two alternatives are desirable and quite often trapped moisture is allowed to remain further and accumulate in a roof to the point that almost all insulating capabilities are lost and rapid deterioration takes place.

BRIEF DESCRIPTION OF INVENTION

After much research and study into the above-mentioned problems, the present invention has been developed to provide a means for ventilating the underside of roof decks to allow the escape of entrapped moisture therefrom. The ventilation openings are relatively large to assure adequate drainage and ventilation since no liquid concrete is being poured onto the corrugated layer.

The present invention is particularly adapted for use in conjunction with pre-existing roof decks but can also be used to provide additional weep holes in structures that have been built with factory punched holes therein or where such pre-existing weep holes were insufficient have been covered during the construction process.

The above is accomplished through the provision of an impacting device mounted on a vertical lift means with a mobile carriage operatively associated therewith. The device has the capability of simultaneously impacting multiple openings and with sensors to allow rapid movement under the corrugated layer of the roof deck to accomplish the ventilating procedure in a speedy and efficient manner.

In view of the above, it is an object of the present invention to provide a means for ventilating roof decks which have moisture impervious layers or highly restrictive vapor and moisture barriers on both sides thereof.

Another object of the present invention is to provide a means for ventilating pre-existing roof decks without the need for scaffolds or other lift means.

Another object of the present invention is to provide a means for ventilating pre-existing roof decks without the need for removing the top waterproof coat or roofing therefrom.

Another object of the present invention is to provide a means for making weep holes in the underside of roof decks to prevent the accumulation of moisture therein.

Another object of the present invention is to provide a fast, highly efficient means for ventilating the underside of roof decks.

Another object of the present invention is to provide a ventilating means for the corrugated layer of concrete roof decks which is inexpensive to operate and yet is highly efficient in results obtained.

Other objects and advantages of the present invention will become apparent from a study of the following description and the accompanying drawings which are merely illustrative of such invention.

BRIEF DESCRIPTION OF FIGURES

FIG. 7 is a schematic view of the lifting frame of the present invention illustrating the means for slidably mounting and upwardly biasing the template.

DETAILED DESCRIPTION OF INVENTION

Figure 1:
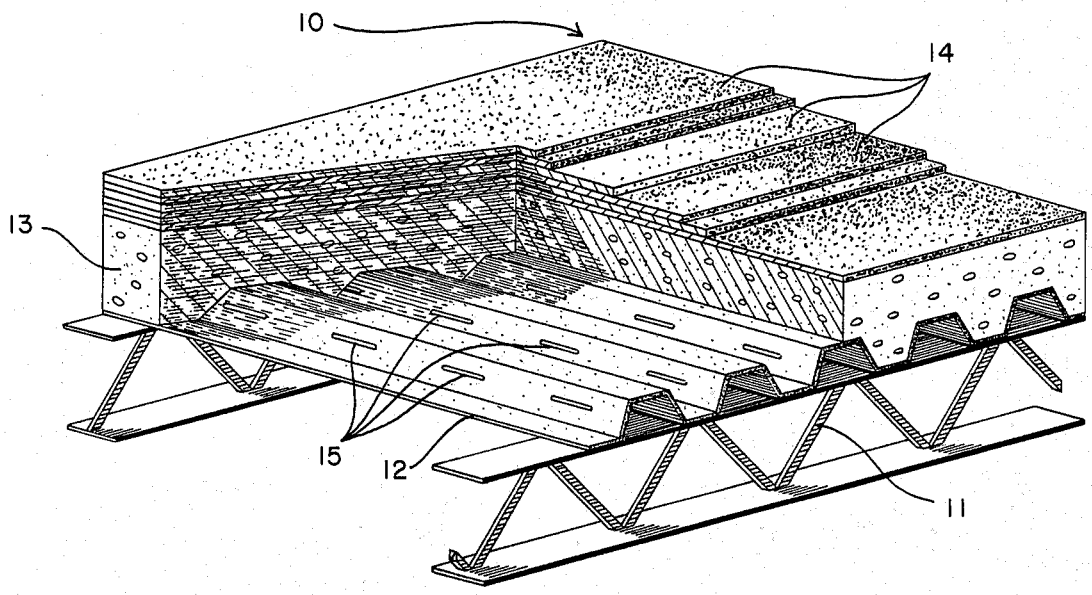
FIG. 1 is a cutaway sectional view of typical lightweight concrete roof structure.

With further reference to the drawings, FIG. 1 discloses a cutaway sectional view of a typical lightweight insulating concrete roof deck assembly, indicated generally at 10, which includes a support structure 11 with corrugated metal or form sheet material 12 laid thereover. Over this corrugated layer 12 is placed a layer of lightweight, insulating concrete 13 or other fluid placed materials or combinations of materials. Finally the roof is finished with a single or a plurality of waterproof layers to prevent moisture from entering the roof deck layer 13.

Over a period of time moisture retained within layer 13 from initial placement or from either condensation created by temperature changes between the two highly liquid impervious layers, i.e. the corrugated layer 12 and the waterproof layer 14, or from leaks in the waterproof exterior layer 14, or from other sources, accumulates in said interior layer 13 of the roof deck 10. This moisture in the concrete layer quickly reduces its insulating qualities and eventually causes deterioration and, if not corrected, ultimately causes complete failure of the roof. Also, the trapped moisture will cause rusting or corroding of the corrugated layer 12 with similar disastrous failure.

The above problems have been recognized and today most buildings being built require that the corrugated form layer have ventilating means or weep openings 15 formed therein prior to installation. These slots or openings, however, do not always allow the moisture trapped between the corrugated and exterior layers to escape.

Additionally, thre are literally thousands of buildings constructed prior to the availability of pre-formed weep holes and many of these structures are now encountering the roofing and other deterioration problems discussed above.

Although theoretically scaffolds could be erected and workman using drills could drill holes in the corrugated layer to vent the same, in reality this method is economically impractical since the roof decks are usually 20 to 30 feet or more from the floor, cover great expanses, and required great numbers of holes of workable sizes.

Further, theoretically holes could be drilled from the top by workman using drills and plugging holes in the concrete. In reality this method also is economically impractical to obtain adequate ventilation and requires a new waterproof exterior layer.

Keeping the above in mind, the present venting apparatus, indicated generally at 16, has been developed to provide a readily movable venting means which can cover large areas in a short time at great heights. This apparatus can be operated by one person and can be used on both unvented and factory vented corrugated layer. This apparatus also provides venting without requiring the waterproof exterior layer 14 to be replaced.

More specifically, the venting apparatus 16 of the present invention includes a lift portion, indicated generally at 17, and an impacting head portion, indicated generally at 18.

The lift portion 17 includes a frame 19 having axle mounted rear wheels 20 and swivelly mounted front caster wheels 21. A slide-hoist 22 is vertically mounted on frame 19 and is operatively connected to a drive means 23, which through a series of pulleys 24 and cables 25, raises and lowers said slide-hoist. An up and down control 26 is provided which is operatively connected to the drive means 23 through wire 27.

Wheel supported, frame mounted slide-hoist of the type described above are commercially available. One such means is Model Number PSL-24 Powered Super Lift manufactured by Genie Industries, 18340 NE 76th Street, Redmond, Wash. 98052. In view of this commercial availability of the lift means, further detailed discussion of the same is not deemed necessary.

The impacting head 18 includes a box-like frame 28. A lift frame 29 is fixedly secured to the top of box frame 28 at opposite ends thereof as can clearly be seen in FIG. 2. Lift arms 30 are pivotively mounted, as indicated at 31, to lift frame 29. These lift arms have their ends opposite the pivot mounting interconnected by lift bar 32.

Figure 2:
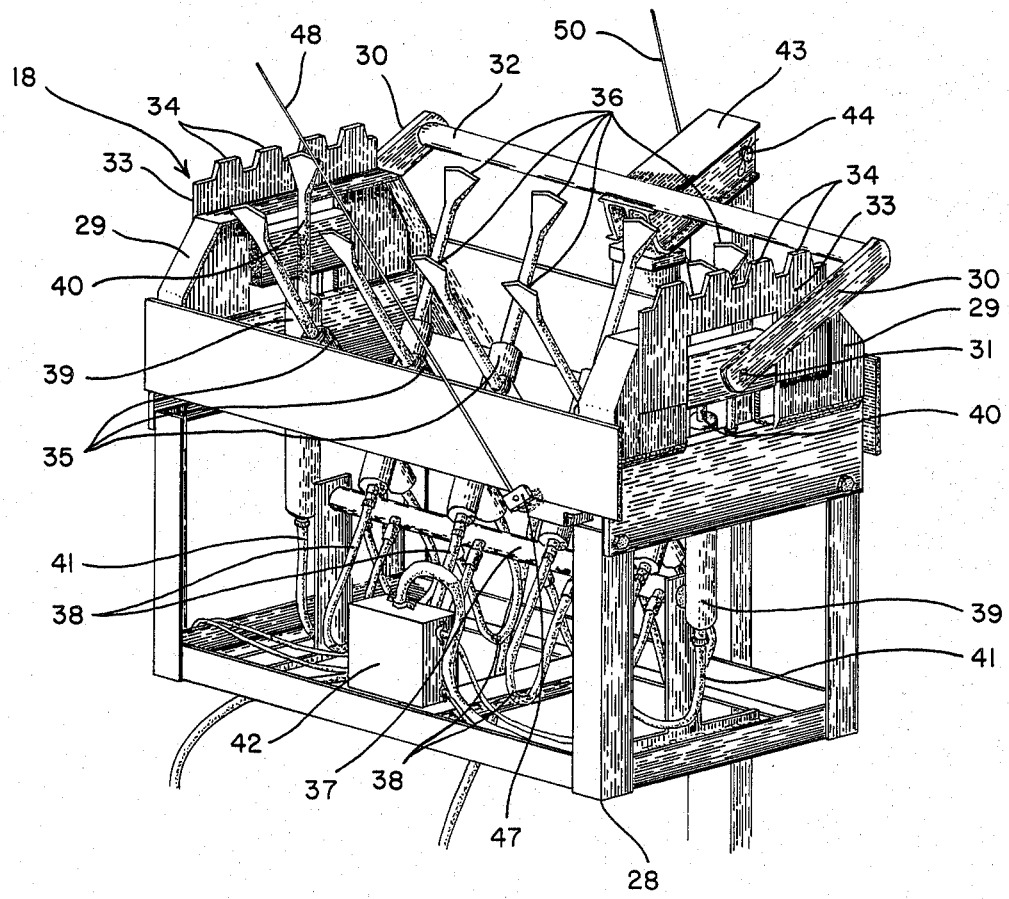
FIG. 2 is a perspective view of the impacting portion of the present invention.

A template 33 is slidably mounted and upwardly biased on each of the lift frames 29 and have a corrugation conforming upper edge 34, again as can clearly be seen in FIGS. 2 and 7.

A plurality of air hammers 35 are securely mounted interiorly of box-like frame 28 and are disposed alternately right and left at an angle of approximately 30 degrees from vertical. Each of these angled air hammers 35 operatively mount a chisel or impacting tool 36 and are operatively connected to a common pneumatic manifold 37 by flexible lines 38.

At least two vertically disposed air hammers 39 are securely mounted interiorly of box-like frame 28. Each of the vertical air hammers mounts a vertical chisel or impacting tool 40 and are commonly connected through flexible lines 41.

A housing for controls 42 is conveniently mounted within box-like frame 28. The controls connected to housing 42 will hereinafter be discussed in greater detail.

A head portion lift arm 43 is fixedly secured at one end to lift bar 32 and is hingedly mounted at its opposite end to the upper portion of slide-hoist 22 as indicated at 44. The piston 46 of lift cylinder 45 is also mounted on the upper portion of slide-hoist 22 with said lift cylinder 45 being pivotively mounted to the underside of head lift arm 43 as shown at 45' and as can clearly be seen in FIG. 3.

A limit switch 47 is operatively mounted on impacting head 18 as shown in FIG. 2. A sensing finger 48 extends outwardly and upwardly at an angle from limit switch 47. This sensing finger 48 is preferably constructed from spring steel to prevent damage to the switch when the finger contacts the underside of the roof deck 10.

A second limit switch 49 is mounted on the upper portion of slide hoist 22 adjacent pivotively mounted head lift arm 43. Limit switch 49 includes a flexible sensing finger 50 which is disposed angularly in an upwardly direction.

Sensing finger 48 and limit switch 47 controls the pneumatic supply to manifolds, while sensing finger 50 and its associated limit switch 49 controls the upward movement of said hoist as will hereinafter be discussed in greater detail. Limit switch 47 is operatively connected to control valves 57 and 58 and functions as a safety switch. Air hammers 35 and 39 are only operative when the impacting head 18 is disposed closely adjacent the roof deck 18 since in that position finger 48 is depressed and accordingly actuates limit switch 47.

An air regulation portion, indicated generally at 51, includes an air pressure accumulator 52 and an associated control unit operatively mounted within housing 53. Recoil hoses 54 and 55 operatively connect the pneumatic controls within housing 53 to the groups of air hammers 35 and 39 of impacting head 18, and head lift cylinder 45, respectively.

The pneumatic regulation portion 51 of the present invention including the air pressure accumulator 52 is supportingly mounted on the forward portion 19' of frame 19. This pneumatic portion is operatively connected to a compressor or other air supply source through hose 56.

Figure 3:
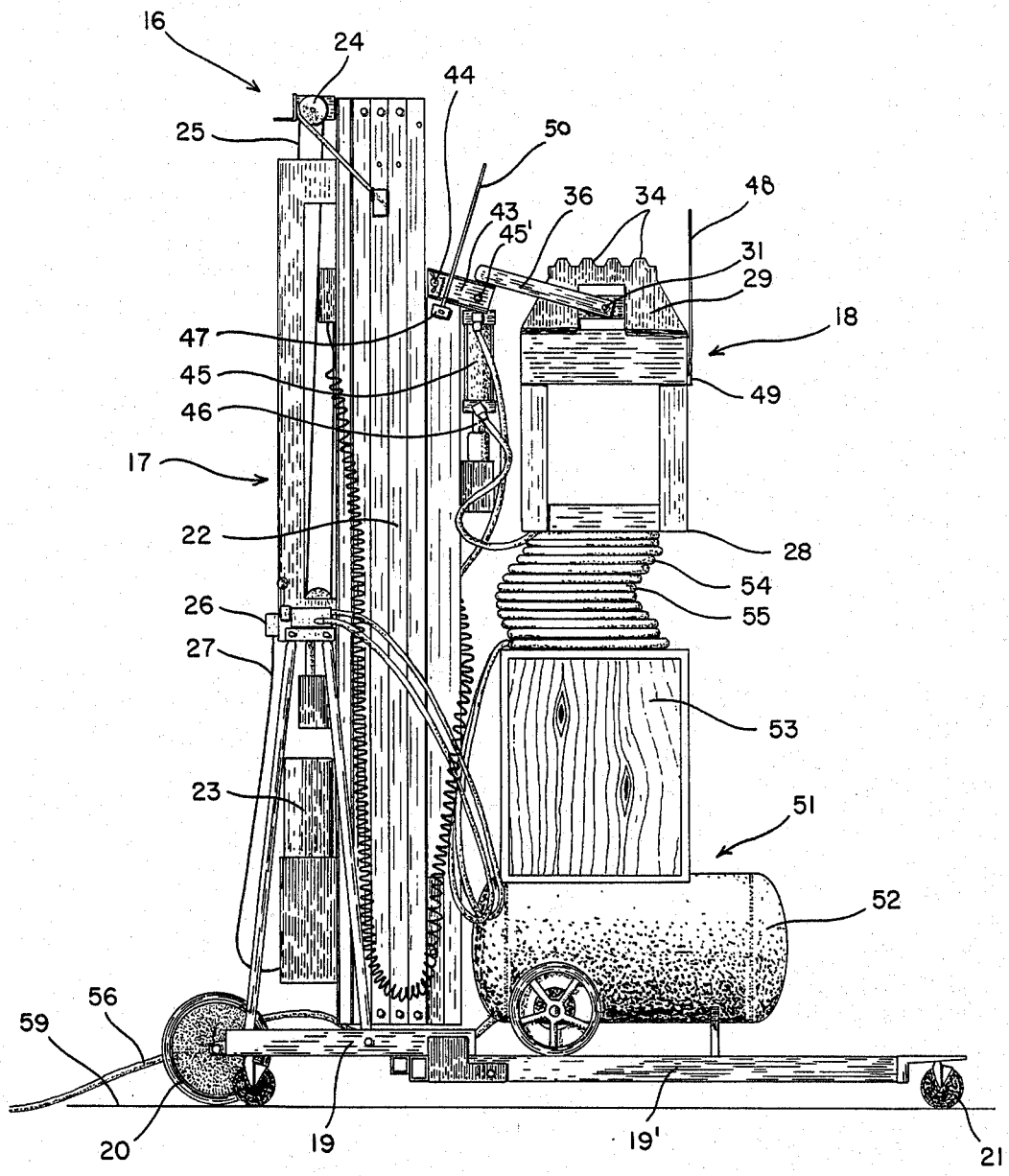
FIG. 3 is an enlarged side elevational view of the venting means of the present invention.
Figure 5:
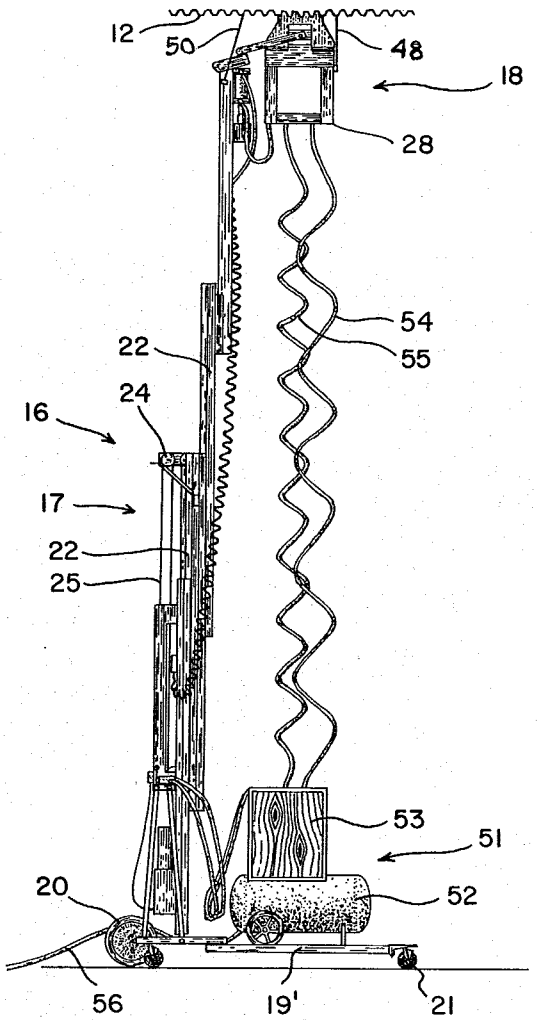
FIG. 5 is a side elevational view of the present invention in raised position.
Figure 4:
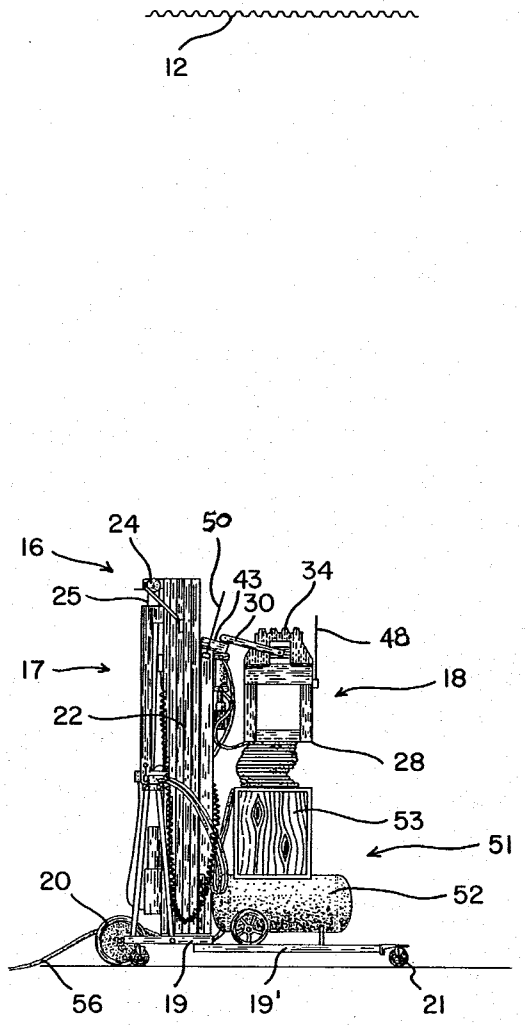
FIG. 4 is a side elevational view of the present invention in lowered position.

When the impacting head 18 is in its retracted or lower position as seen clearly in FIGS. 3 and 4, the recoil hoses 54 and 55 neatly coil themselves on the upper portion of housing 53. When the head portion 18 is extended as shown in FIG. 5, the recoil hoses are extended therewith. Since hoses of this type are well known to those skilled in the art, other detailed description of the same is not deemed necessary.

Figure 6:
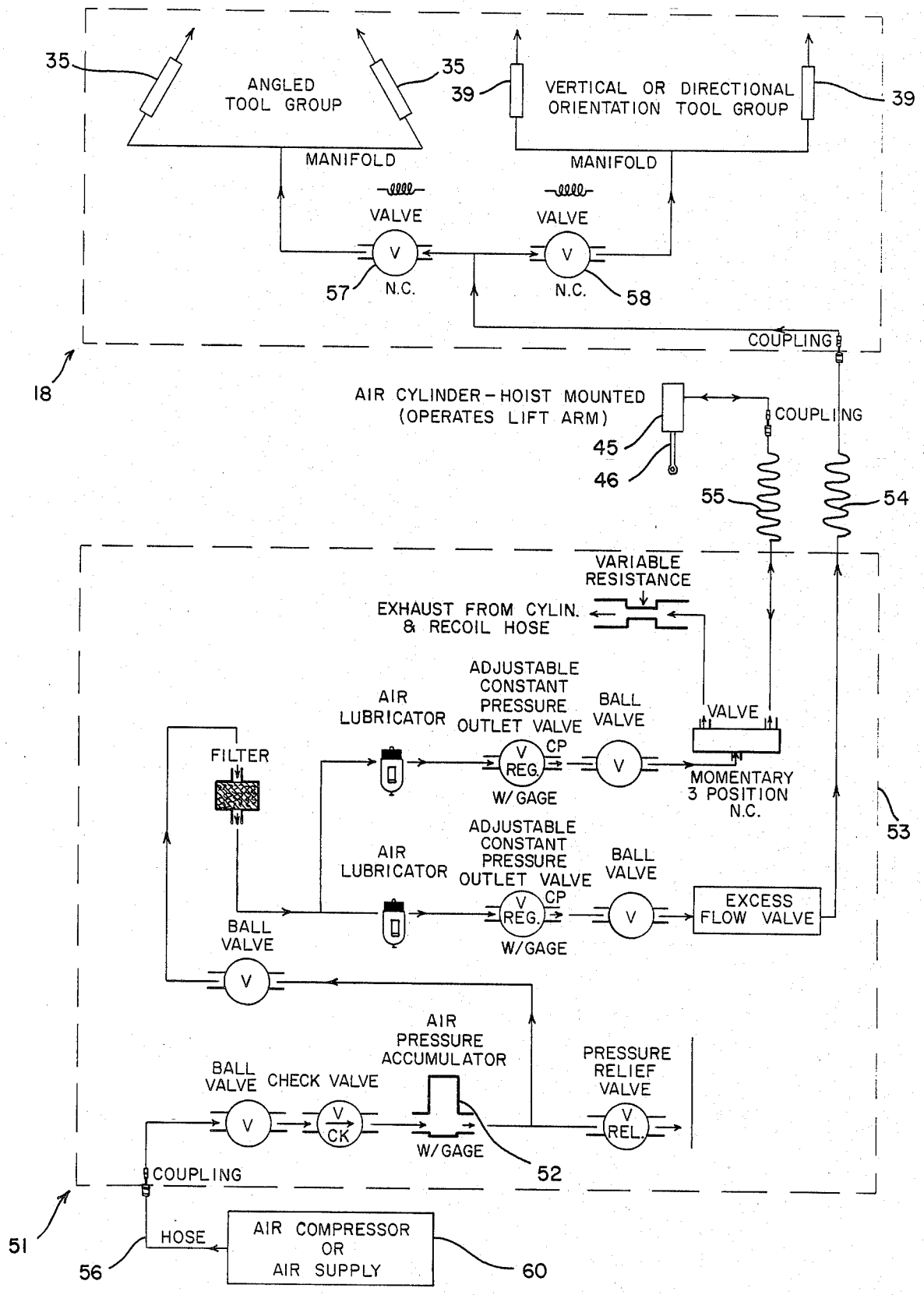
FIG. 6 is a schematic of the pneumatic portion of the present invention.

A schematic of the pneumatic control means of the present invention is clearly shown in FIG. 6. Compressed air from the air supply or compressor 60 passes through hose 56 into accumulator 52. The compressed air then, through normal controls as labeled on the drawing, selectively enters one or both of the recoil air hoses 54 and 55 to operate either the impact head 18 or the head lift cylinder 45.

When the head lift cylinder is activated, it pushes up on lift arm 43 which raises the upper edges 34 of templates 33 which are juxtaposed to the underside of corrugated layer 12 positioning impacting tools 36 and/or 40 adjacent thereto. With reference to FIG. 6, note that the lift arm 43 is actuated by cylinder 45 which is controlled by a three position manually operated control valve. Consequently, the lift arm 43 is manually controlled by this control valve 98 (FIG. 6). Since it is a three position control valve it enables the operator to both raise and lower the lift arm. When template 33 is further forced upward by lift arm 43, the force compresses the upward bias of template 33 with respect to frame 29 and operates internal mounted limit switches operatively connected to control within housing 42. Wiring from housing 42 selectively causes operative valves 57 and/or 58 to supply air to manifolds, and air hammers.

Once the impacting tools have vented the corrugated layer of the roof deck, the impacting motion is stopped through further movement of template 33 and thus connected limit switches to stop operation of respective control valves 57 and 58. As noted before, template 33 is slidably mounted and upwardly biased on the lift frame 29. Thus as the chisels 36 penetrate the roof, the lift frame will move upwardly with respect to the template 33 causing the internal limit switches to be actuated, thereby controlling valves 57 and 58. Since control valves and limit switches of this type are well known to those skilled in the art further detailed discussion of the same is not deemed necessary.

Through automatic control or manual manipulation of the normal regulator valve, the lift cylinder can be lowered when the venting operating has been completed in roof deck 10.

Recoil hose 54 is operatively connected through cylinder control valves 57 and 58 (which are operatively connected to control within housing 42 of impacting head portion 18) to the manifolds of either the angled hammer group or the vertical hammer group, or both, to operate the air hammers 35 and/or 39 and their associated impacting tools 36 and 40 to render repetitive blows at the rate of approximately four thousand per minute against the corrugated layer 12 of roof deck 10.

The air hammers described above are commercially available. One such means is Ingersoll Rand Model 182 L Scaller fitted with a non-rotary impact tool, also fitted with air control means and chisels especially shaped.

The preferred shape of chisels is pointed for penetration and sharpened for cutting long narrow ventilation openings with long direction as can clearly be seen in FIG. 2.

To use the ventilating means 16 of the present invention, the same is moved along the floor 59 or other supporting structure until it is directly beneath the roof deck 10 and its associated corrugated layer 12. The lift control 26 is then manipulated to activate the drive means 23 which, through associated pulleys and cables 24 and 25, will cause the slide hoist 22 of the lift portion 17 to move upwardly from the position shown in FIG. 3 to the position shown in FIG. 5 carrying impacting head 18 upwardly therewith.

When sensing finger 50 engages the underside of the roof deck 10, limit switch 49 will automatically stop the upward movement of slide hoist 22 by deactivating drive means 23. Pneumatic cylinder 45 will then activate through manipulation of normal regular valve to pivot lift arm 43 and, through associated lift arms 30, raise the impacting head 18 upwardly toward the lower side of the corrugated layer 12 of roof deck 10.

Once the upper edges 34 of the corrugation conforming templets 33 are juxtaposed to the underside of corrugated layer 12, templates 33 will operate their associated limit switch to operate, selectively, control valves 57 and/or 58.

Next, the selected air hammer group 35 or 39, or both, will then begin moving the impacting tools 36 and/or 40 longitudinally back and forth thus rapidly impacting the corrugated layer 12 of the roof deck 10. These repeated blows of the impacting tools will quickly and readily penetrate even the heaviest gauge of roof deck corrugated material in general use today. Above the corrugated material 12 the lightweight insulating concrete 13 is relatively low in strength and is penetrated easily by the impacting tools. The penetration into concrete layer 13 results a surface area for ventilation from the concrete greater than the area of the opening through the corrugated material 12.

Once penetration has been sensed, limit switches stop tool impacting. Then the lift cylinder 45 drops the impacting head 18 away from the corrugated layer 12. The wheeled frame 19 can then be moved a distance equal to the pattern of impact openings formed in the corrugated layer. The lift cylinder 45 can then be reactivated, repeating the process of raising the head 18, impactingly forming a series of openings in the corrugated layer 12 and penetrating the concrete layer 13, and retracting the head so that the ventilating means can again be moved to a new impacting area.

From the above it can be seen that large expanses of corrugated roof decking can be systematically and quickly ventilated by simply rolling the wheeled ventilating means of the present invention from one impact location to another. The labor required in accomplishing this is minimal, requiring only one workman who operates the controls and move the carriage or frame between the ventilating sequences.

Once the sequential ventilating of the entire roof deck has been accomplished, the lift portion 17 can be lowered along with its associated impacting head 18 to the position shown in FIGS. 3 and 4. When in this lowered or retracted position, the entire ventilating means 16 of the present invention can be rolled through normal size doorways to the next desired ventilating location or job. Lift portion 17, pneumatic regulation portion 51, and impacting head 18 are quickly separated so that the three components can be unloaded, assembled, operated, disassembled, and reloaded with minimal labor, requiring only one workman.

From the above it can be seen that the preferred embodiment of the present invention provides a design shape, orientation and pattern of plural openings in a low permeability surface to increase permeability while at the same time having the following additional benefits: The shape and area of each penetrations forms a ventilation area larger than the opening through the low permeable surface that will pass fluid construction material. This is achieved by openings for ventilation being installed after construction material has set and the process of additional drying or venting is desired. The shape and configuration of openings are designed to permit easy withdrawal of the cutting tools. The configuration of the pattern of the openings for increasing permeability have homogenous effects. Orientation of the longitudinal axis of the openings permit the surface being machined to maintain maximum structural strength. A majority of the openings are in a pattern that does not cut portions of surface where the greatest need for structure strength is, but rather cuts at or near neutral axis or surface element structural strength. The present invention permits selected placement of sufficient openings in locations that allows passage of any accumulated moisture by gravity at the lowest points in the structure, and further permits selected patterns of openings in locations near the greater concentration of vapor to allow for greater drying or venting of vapor (i.e. in a roof assembly the greater concentration of moisture vapor location varies with seasons and conditions; openings having the highest points generally result in increased drying rates).

The shape of opening edges are such that they are not excessively sharp nor hazardous to touch as in the case with drilled holes. No hazardous debris is created during the forming of the openings by the device of the present invention as occurs as a result of drilling. The opening configurations, in addition to ventilation benefits, also produces acoustical benefits to adjacent spaces by absorbing portions of sound waves. The opening configurations are generally unobtrusive when viewed. Finally, the openings are positioned to assist in locating undesirable substances such as water entrancing from roof leaks.

Traditionally wet insulation within a roof assembly requires removal of the insulation necessitating complete removal of roofing or leaving wet, non-functional insulation. Reroofing with or without additional insulation is extremely expensive. With the machine and of the present invention, insulation material can remain in place, and when dried will function properly and have an extended service life.

The present invention has the advantage of providing a relatively simple but highly efficient means for ventilating roof decks of the lightweight insulating concrete and corrugated metal type. The device uses very little energy, can be operated by one person, accomplishes outstanding results, and can be easily transported.

The present invention can, of course, be carried out in other specific ways than those herein set forth without departing from the spirit and essential characteristics of the invention. The present embodiments are, therefore, to be considered in all respects as illustrative and not restrictive, and all changed coming within the meaning and equivalency range of the appended claims are intended to be embraced therein.

What is claimed is:

1. The method of forming ventilating openings in roof type structures comprising: mounting an impacting head having a plurality of impacting means operatively associated therewith on a lift means; moving said lift and associated impacting means to a location below the underside of the roof structure to be ventilated; actuating said lift means to raise said impacting head to a point adjacent to underside of said roof structure; actuating at least a portion of the plurality of impacting means to form openings in the underside of said roof structure when said impacting head is brought into close proximity to said roof structure; deactivating said impacting means when said roof structure is penetrated; moving said lift and impacting means to a new location below the underside of said roof structure; and repeating the ventilation opening forming procedure whereby large expanses of roof structure can be quickly and readily penetrated.

2. A means for forming ventilating openings in the underside of a roof structure of the type having a corrugated metal layer comprising: an impacting head having a plurality of impact cutter means for impacting and penetrating said corrugated metal layer; lift means for raising and lowering said impacting head and associated impact cutter means; means for actuating said impact cutter means when said impacting head and associated impact cutter means are brought into close proximity to said roof structure; and means for automatically deactivating said impact cutter means when said corrugated metal layer has been penetrated.

3. The ventilating means of claim 2 wherein said impact cutter means includes an air hammer operatively mounting a chisel like tool.

4. The ventilating means of claim 2 wherein a portion of said impact cutter means are vertically disposed for forming openings in substantially horizontal portions of said corrugated metal layer and another portion of said impact cutter means are angularly disposed for forming openings in the inclined portions of said corrugated metal layer.

5. The ventilating means according to claim 2 wherein said actuating and deactivating means including a spring biased template mounted to said impacting head and movable between a first extended position and a second compressed position, said template being biased to said extended position, said actuating and deactivating means further including at least one switch operative to actuate and deactivate said impact cutter means, said switch being actuated by said spring biased template as the same moves from its first position towards its second position.

6. The ventilating means according claim 2 further including a first limiting switch for deactivating said lift means when said impacting head is brought into close proximity to said roof structure.

7. The ventilating means according to claim 6 further including second limiting switch means for enabling said impact cutter means only when said impacting head is in close proximity to said roof structure.

* * * * *